US005533421A

United States Patent [19]

Damerow et al.

[11] Patent Number: 5,533,421

[45] Date of Patent: Jul. 9, 1996

[54] INTEGRATED PLASTIC BRAKE/CLUTCH PEDAL

[75] Inventors: Robert L. Damerow, Garden City; David M. Zedan, Eastpointe, both of Mich.

[73] Assignee: Chrysler Corporation, Auburn Hills, Mich.

[21] Appl. No.: 364,866

[22] Filed: Dec. 27, 1994

[51] Int. Cl.[6] ..... G05G 1/16

[52] U.S. Cl. ..... 74/563; 74/560

[58] Field of Search ..... 74/560, 563, 512

[56] References Cited

U.S. PATENT DOCUMENTS

| | | | |
|---|---|---|---|
| 1,210,016 | 12/1916 | Sunden | 74/563 |
| 1,439,065 | 12/1922 | Burlock | 74/563 |
| 5,074,163 | 12/1991 | Baumann | 74/560 X |
| 5,321,995 | 6/1994 | Zedan | 74/563 |

FOREIGN PATENT DOCUMENTS

| | | | |
|---|---|---|---|
| 503884 | 3/1920 | France | 74/563 |
| 2501778 | 7/1976 | Germany | 74/563 |
| 3528351 | 2/1987 | Germany | 74/560 |
| 4211640 | 10/1993 | Germany | 74/560 |
| 230223 | 11/1985 | Japan | 74/563 |

*Primary Examiner*—Rodney H. Bonck
*Assistant Examiner*—Mary Ann Battista
*Attorney, Agent, or Firm*—Edward A. Craig

[57] ABSTRACT

An integrated brake/clutch arm and pedal pad combination for an automotive vehicle in which the arm is made of a plastic material and comprises an elongated lever body having an integral end portion formed to provide a pad holder. A pad also made of plastic material is molded to the pad holder and is of a somewhat softer material to provide frictional resistance and prevent a foot from slipping off. The plastic materials of the arm and pad are compatible and provide an integral bond when the pad and pad holder are molded together.

1 Claim, 2 Drawing Sheets

INTEGRATED PLASTIC BRAKE/CLUTCH PEDAL

FIELD OF THE INVENTION

This invention relates generally to a plastic brake or clutch pedal for an automotive vehicle having a plastic arm or lever and a plastic pad which is pressed by the foot of the driver to operate the pedal.

BACKGROUND AND SUMMARY

Currently the brake or clutch pedal of an automotive vehicle consists essentially of an arm or lever made of metal having a metal pad holder on one end. The arm and pad holder are separately formed as by stamping, and welded together. A pad is then fitted over the pad holder. U.S. Pat. No. 5,321,995 shows an example of a parking brake pedal of this general construction.

In accordance with the present invention, both the arm or lever and the pad are made of plastic. The arm or lever preferably comprises an elongated lever body having an integral pad holder on one end. The pad is molded to the pad holder, preferably in a recess formed in the pad holder. The arm and pad are preferably made of compatible plastic materials so that when molded together a molecular bond or weld is obtained. No adhesive is required.

The arm and pad of the brake or clutch pedal of this invention is lighter in weight than the current pedal, can be made by a simplified manufacturing process, is less expensive, and comprises fewer parts.

One object of this invention is to provide a brake or clutch pedal for an automotive vehicle having the foregoing features.

Another object is to provide a brake or clutch pedal which is composed of fewer parts, is rugged and durable in use, and is relatively easy to manufacture and assemble.

Other objects, features and advantages of the invention will become more apparent as the following description proceeds, especially when considered with the accompanying drawings.

DETAILED DESCRIPTION OF THE PREFERRED EMBODIMENT

Figure 1:
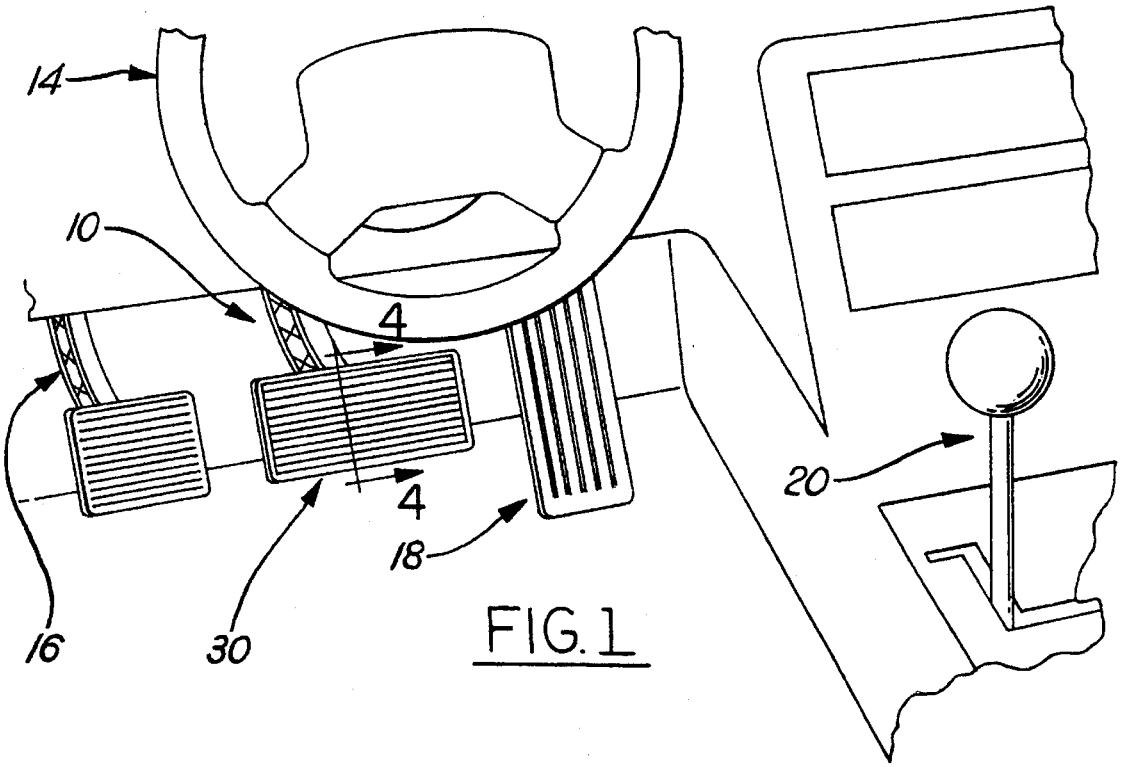
FIG. 1 is a fragmentary perspective view of the interior of an automotive vehicle showing a brake pedal constructed in accordance with the present invention.
Figure 4:
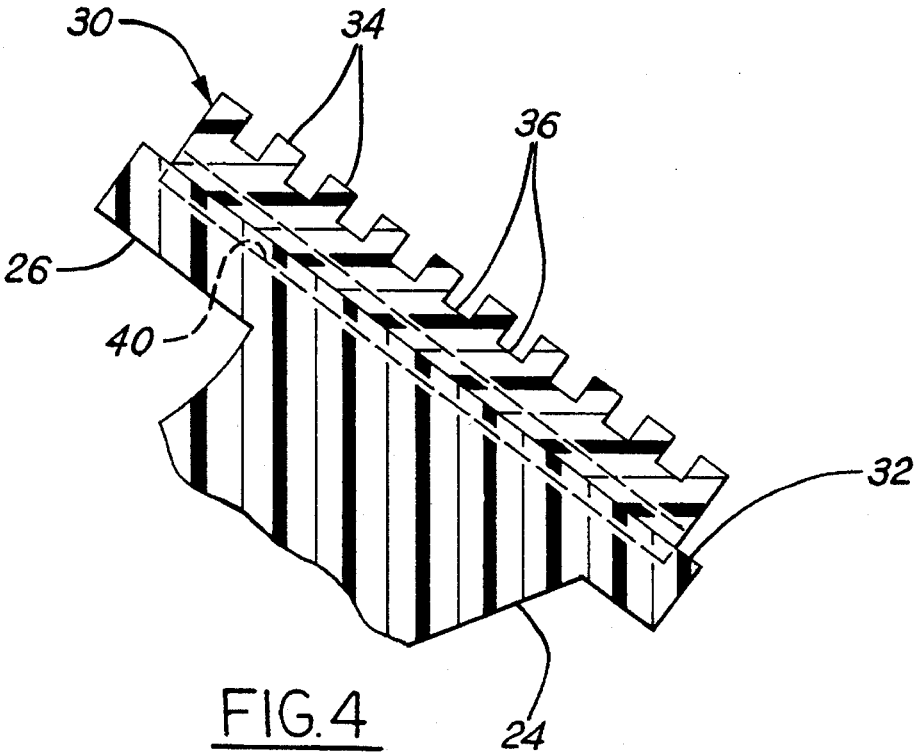
FIG. 4 is an enlarged fragmentary sectional view taken on the line 4—4 in FIG. 1.
Figure 3:
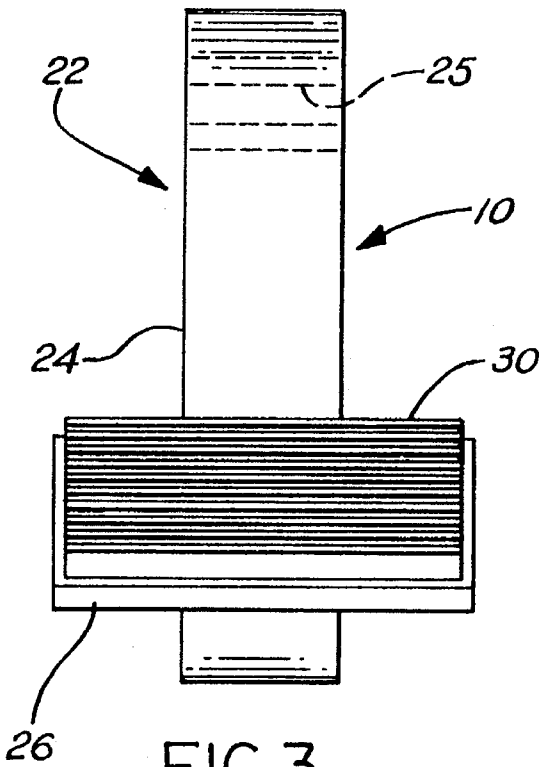
FIG. 3 is a front elevational view of the brake pedal shown in FIG. 2.
Figure 2:
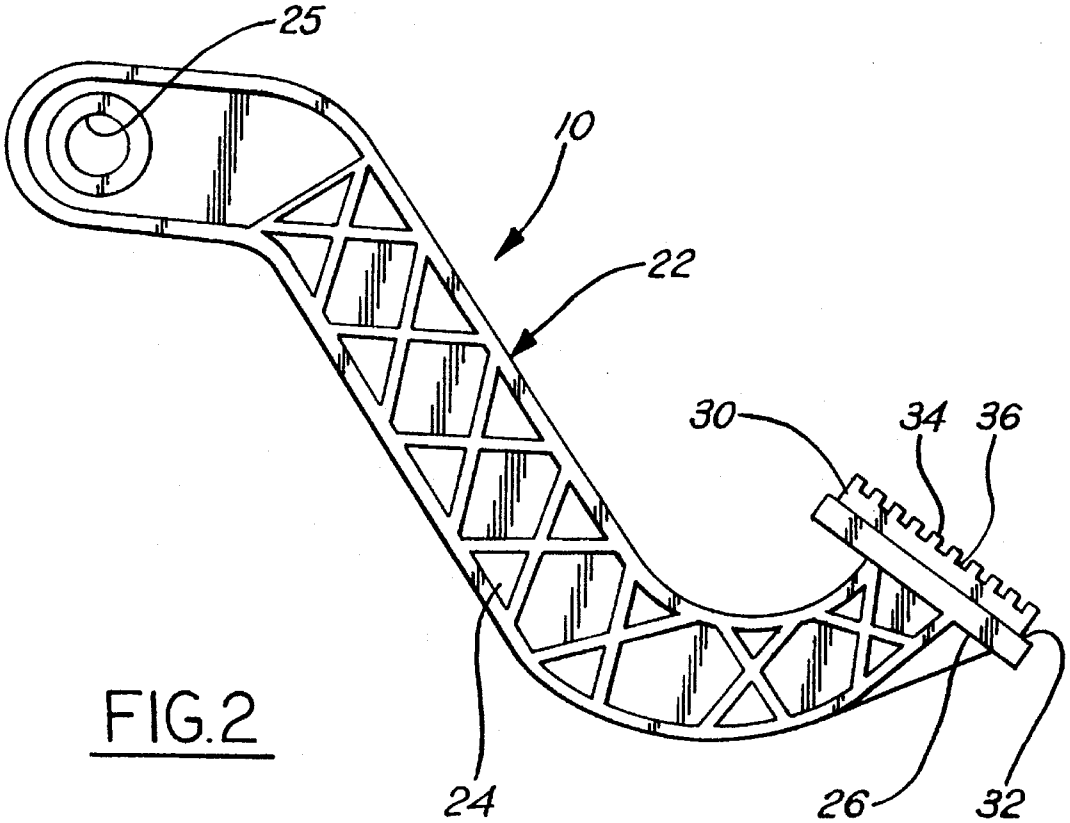
FIG. 2 is a side elevational view of the brake pedal.

Referred now more particularly to the drawing, and especially to FIG. 1, a pivoted brake pedal 10 of an automotive vehicle is shown extending into the passenger compartment of an automotive vehicle adjacent to the driver's seat and beneath the instrument panel 12. Also shown in FIG. 1 are the steering wheel 14, clutch pedal 16, accelerator pedal 18 and gear shift lever 20.

The brake pedal 10 is in the form of an arm 22 made of a plastic material and comprising an elongated lever body 24 having a hole 25 at one end for receiving a pivot pin (not shown) enabling the pedal to pivot up and down in a conventional manner. The lever body has a pad holder 26 at the opposite end. The lever body and pad holder are of one piece unitary construction and molded to the configuration shown out of plastic in a simple molding operation. The arm 22 is thus an integral, one-piece member consisting of the lever body 24 and the pad holder 26.

A pad 30 which is applied to the front face 32 of the pad holder 26 is a single block of plastic material which is generally rectangular in shape, preferably having a corrugated outer surface formed by alternate horizontal ribs 34 and grooves 36. Preferably, the pad holder 26 of the brake arm has a rectangular recess 40 in its outer surface in which the base of the pad fits snugly.

Various different materials may be used to make the brake arm. For example, the brake arm may be made of nylon or a nylon-based thermoplastic elastomer. Other suitable materials are polyester, polythalamide, polypropylene, polycarbonate, polyvinyl chloride (PVC) or acrylonitrile-butadiene-styrene (ABS). Nylon is the preferred material for the brake arm because of its relative hardness and stiffness as well as for its low cost and high strength characteristics. Glass fibers may be added to the nylon to increase the strength of the brake arm. A brake arm thus constructed has good chemical resistance characteristics.

The brake pad 30 is preferably formed of a plastic material which is compatible with the plastic material of the brake arm 22. The pad is preferably a thermoplastic elastomer. The material of the pad is preferably softer than the material of the brake arm and has a rubber-like quality. Because it is relatively soft and because of its corrugated outer surface, it has a frictional resistance to prevent a foot from slipping off when the brake is applied. Suitable materials for the plastic pad might be polypropylene or any one of the materials suggested for the manufacture of the brake arm, although it should be somewhat softer and have a frictional resistance for the purposes noted.

The pad 30 is preferably formed by injection-molding it into the recess in the pad holder 26 of the brake arm 22 under the necessary heat and pressure to cause the pad to form and to bond to the material of the pad holder. Because the materials of the brake arm and pad are compatible plastics, there is produced what in effect is a molecular bond or welding together of the two materials so that no adhesive or any other mechanical means are required to maintain the parts in assembly.

Whereas the metal levers used currently have to be formed separately from the metal pad holders and then welded together, and then the pad has to be stretched over the pad holder in a further manufacturing step, in accordance with this invention, the lever body 24 of the arm 22 and the pad holder 26 are molded as one integral unit out of plastic and then the pad is molded into a recess in the pad holder. The weight of the brake lever constructed as described herein is less than the weight of brake levers having metal arms in accordance with current practice, the manufacturing process is simpler, the ultimate product is less expensive, and a strong and durable brake pedal is achieved.

It will be understood, of course, that the invention is not limited to brake pedals, but that the clutch pedal as well as a parking brake pedal may be similarly formed in accordance with this invention. Accordingly, the clutch pedal 16 should be understood to be of the same construction and materials as the brake pedal 10.

What is claimed is:

1. An integrated arm and pedal pad combination for use as a brake or clutch lever in an automotive vehicle, said arm being of integral, one-piece construction and made of a plastic material, said arm comprising an elongated lever body having an integral end portion formed to provide a pad holder, said pad holder having a pad-receiving recess, said pad being made of a plastic material which is softer than the plastic material of said arm, to provide frictional resistance and prevent a foot from slipping off, said pad being injection molded into said recess of said pad holder, the plastic materials of said arm and said pad being compatible and providing an integral bond between said pad and said pad holder when molded together as aforesaid, said arm being made of nylon reinforced with glass fibers, and said pad being made of a thermoplastic elastomer.

* * * * *